US009615617B2

(12) United States Patent
Davidson et al.

(10) Patent No.: US 9,615,617 B2
(45) Date of Patent: Apr. 11, 2017

(54) BASEBALL STYLE CAP WITH INTERCHANGEABLE BILL OR CROWN PORTION

(76) Inventors: Derrelle P Davidson, Los Angeles, CA (US); Philip Madison Jones, Los Angeles, CA (US)

( * ) Notice: Subject to any disclaimer, the term of this patent is extended or adjusted under 35 U.S.C. 154(b) by 563 days.

(21) Appl. No.: 13/420,613

(22) Filed: Mar. 15, 2012

(65) Prior Publication Data

US 2013/0125291 A1 May 23, 2013

Related U.S. Application Data

(60) Provisional application No. 61/561,430, filed on Nov. 18, 2011.

(51) Int. Cl.
*A42B 1/06* (2006.01)

(52) U.S. Cl.
CPC ..... *A42B 1/064* (2013.01)

(58) Field of Classification Search
CPC ..... A42C 3/00; A42B 1/205; A42B 1/206; A42B 1/22; A42B 1/241; A42B 1/064
USPC .. 2/171.4, 171.5, 171.7, 183, 182.2, 209.12, 2/175.1, 175.3, 195.1, 195.2, 195.3, 2/195.4, 195.5
See application file for complete search history.

(56) References Cited

U.S. PATENT DOCUMENTS 1,598,313 A * 8/1926 Rosenberg ..... 2/171.1
2,855,604 A * 10/1958 Austin ..... 2/416
4,023,212 A 5/1977 Huffman
4,333,180 A 6/1982 Bay
4,630,317 A * 12/1986 Brown et al. ..... 2/12
4,873,726 A 10/1989 Tapia
4,993,081 A * 2/1991 Fulghum ..... 2/209.12
5,070,545 A * 12/1991 Tapia ..... 40/329
5,099,524 A * 3/1992 Linday ..... 2/181
5,125,113 A * 6/1992 Yun ..... 2/10
5,181,277 A * 1/1993 Sherman ..... 2/181.4
5,253,364 A * 10/1993 Robinson ..... 2/10
5,437,062 A * 8/1995 Douglas ..... 2/195.1
5,471,684 A * 12/1995 Casale ..... 2/195.1
5,548,846 A 8/1996 Bianchetti
5,584,076 A * 12/1996 Armstrong ..... 2/195.2
5,613,246 A * 3/1997 Alexander ..... 2/10
5,632,047 A 5/1997 VanDenHeuvel
5,685,017 A * 11/1997 Kraft ..... 2/171.1
5,715,534 A 2/1998 Mobley
5,771,493 A * 6/1998 Proctor ..... 2/209.13
5,862,523 A * 1/1999 Proctor ..... 2/209.11
5,875,493 A * 3/1999 MacDonald et al. ..... 2/172
5,901,370 A * 5/1999 Linday ..... 2/10
6,029,272 A 2/2000 Bazin
(Continued)

*Primary Examiner* — Alissa L Hoey
(74) *Attorney, Agent, or Firm* — Riverside Law LLP

(57) ABSTRACT

A baseball cap with an interchangeable bill is disclosed whereby the user can change the bill of the cap with ease. The design of this product creates a separable bill and crown that integrates into one piece, the adjustment means and brim reinforcement means of the cap and maintains the ease at which one can switch out one bill and replace it with another. An embodiment is also disclosed whereby the replaceable bill is secured in place to prevent accidental dislodgement of the bill when one grabs at the hat to put it on. Another embodiment allows the user to replace the entire crown of the cap without even removing it from the user head.

7 Claims, 3 Drawing Sheets

(56) References Cited

U.S. PATENT DOCUMENTS

| | | | | |
|---|---|---|---|---|
| 6,070,270 | A * | 6/2000 | De La Torre | 2/171.1 |
| 6,094,749 | A * | 8/2000 | Proctor | 2/195.2 |
| 6,263,508 | B1 | 7/2001 | Davis | |
| 37,257 | A1 * | 1/2002 | Hall McKenzie | 2/195.2 |
| 6,374,423 | B1 * | 4/2002 | Anderson et al. | 2/425 |
| 6,473,907 | B1 * | 11/2002 | Harwood | 2/209.13 |
| 7,703,153 | B2 * | 4/2010 | de Taboada | 2/422 |
| 2001/0016958 | A1 * | 8/2001 | Linday | 2/10 |
| 2004/0040067 | A1 * | 3/2004 | Pong | 2/195.2 |
| 2005/0060790 | A1 * | 3/2005 | Cho | 2/209.12 |
| 2007/0017003 | A1 * | 1/2007 | Harris et al. | 2/195.1 |
| 2008/0115257 | A1 * | 5/2008 | Hernandez | 2/195.2 |
| 2008/0115258 | A1 * | 5/2008 | Hernandez | 2/209.12 |
| 2010/0186147 | A1 * | 7/2010 | Garza | 2/209.12 |

* cited by examiner

FIG. 1
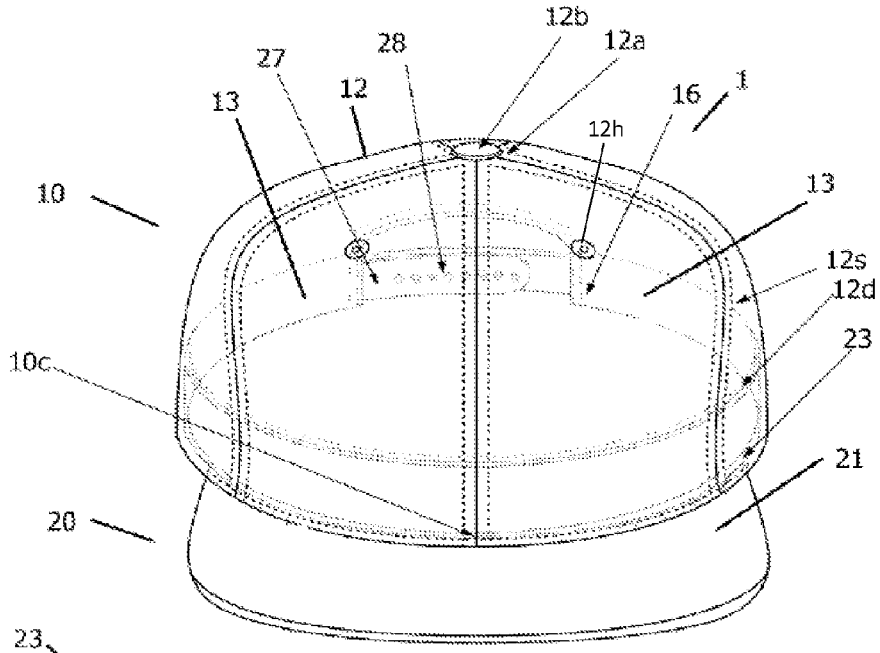
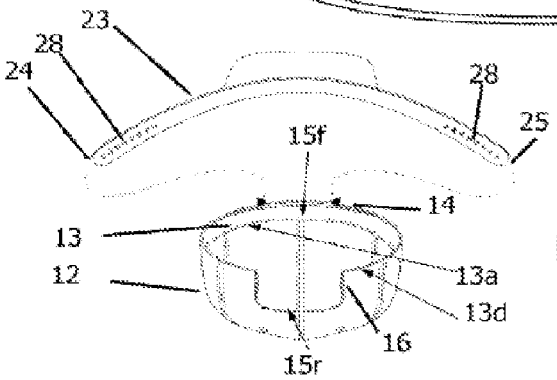
FIG. 2
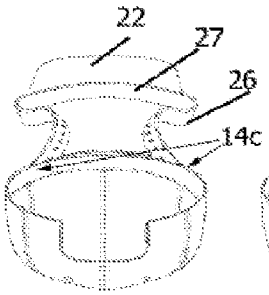
FIG. 3
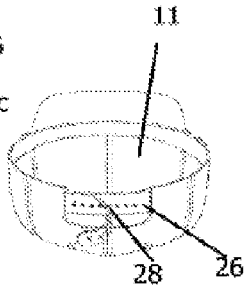
FIG.4

DRAWING SHEET 3 OF 3
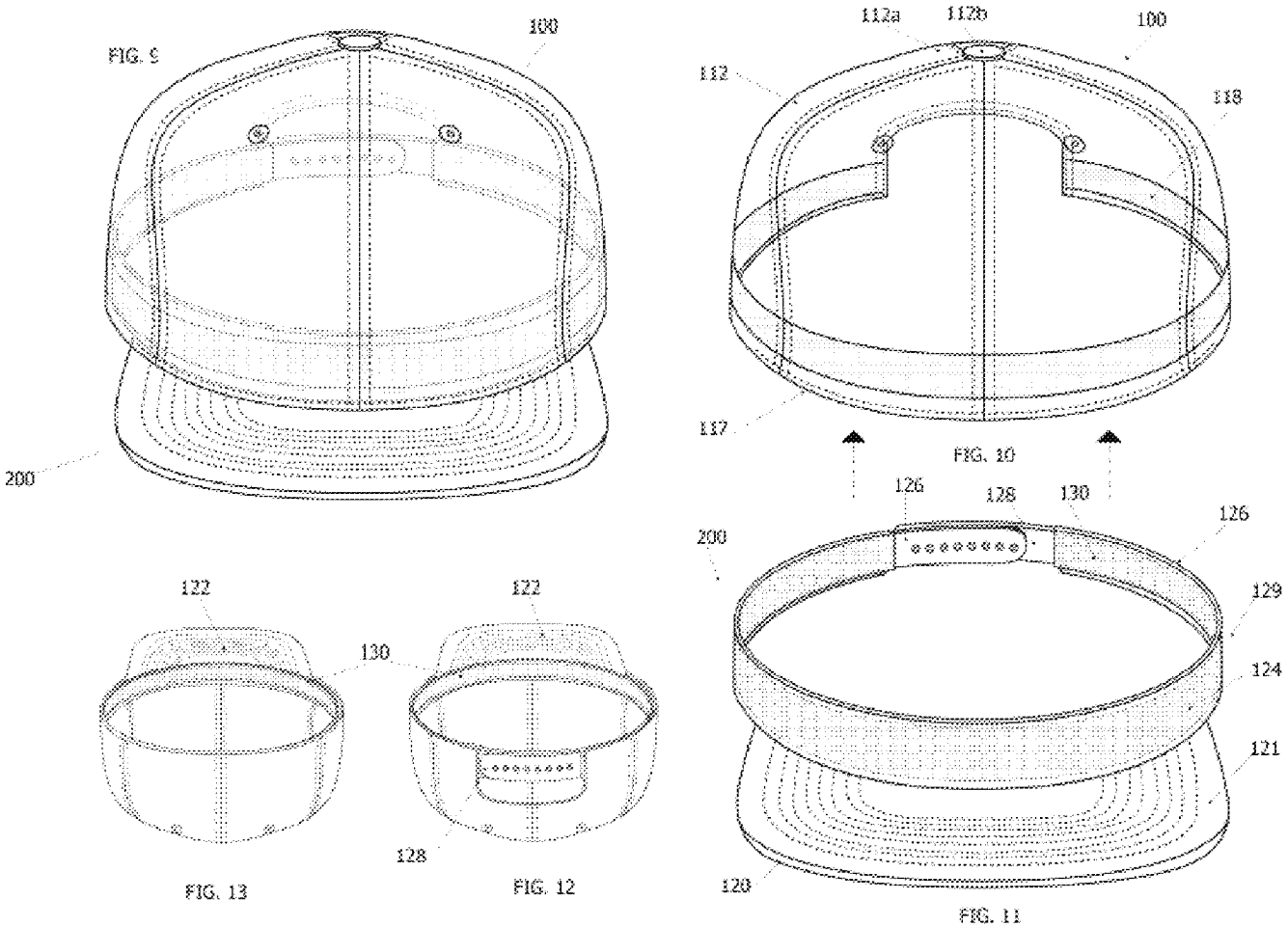

BASEBALL STYLE CAP WITH INTERCHANGEABLE BILL OR CROWN PORTION

CROSS-REFERENCE TO RELATED APPLICATIONS

This application claims benefit of prior filed provisional application No. 61/561,430 entitled "Baseball Style Cap with Interchangeable Bill Portion" filed on Nov. 18, 2011 in the name of Darrelle Davidson and Philip Madison Jones, said provisional application being hereby incorporated by reference as if fully set forth herein.

SUMMARY OF THE INVENTION

This invention's principal object is to facilitate the fashion industry with a product that has both aesthetic qualities and functional abilities to suit the ever changing desires of the general public in terms of hats. It is a fashion trend and an utilitarian need to wear baseball style caps, especially when it comes to preventing the sun and it's damaging rays from hitting a person's face. Many of today's most popular people wear many different styles and colors of hats and keeping many different hat combinations are both prohibitively expensive and storage and accessibility becomes a major issue. This invention will solve these problems with the principal object of this invention to create a fashionable and utilitarian solution to the problem of shading one's face from the sun's rays, while making a fashion statement.

BACKGROUND OF THE INVENTION

Devices that shade one's eyes from the glare of the sun have been traced back to ancient Greeks in 600 BC where historians have found examples of headwear whose purpose is to provide shade to one's face. It was also seen that these headdresses had both a functional as well as a class purpose, where hats adorned with jewels signified class and culture. Today, baseball style caps are worn by many and the purpose has not greatly changed. Caps are worn for protection but are also worn to signify one's desire to be associated with a particular class of people. Whether the class of people desire to show their support to a particular sports team or for a particular cause, such as pink symbolizing their support for the awareness for breast cancer survivors, caps can have symbolic purposes and functional ones at the same time.

This invention recognizes that while one might require various caps to show support to various causes the problems associated maintaining storage for these many caps causes problems. This invention discloses a capping system, whereby one has the ability to use a single crown section of a baseball style hat with an interchangeable system of types, styles and colors of bills. An embodiment of this invention allows uses to be able to change the crown and/or the bill of the cap.

A typical baseball style cap consists of 3 main components. The Crown, the Brim and the Bill. The Crown is usually made with multiple panels that are conjoined at the apex of the crown. The inner circumference of the open portion of the crown, opposite the apex, is the Brim while the part emanating perpendicular from the plane of the brim is the Bill. This invention deals with the interchangeability of the bill and/or crown portion while maintaining the style, purpose and function of the remaining parts.

Prior art has shown that hats exist with interchangeable features. U.S. Pat. No. 4,023,212 issued to Huffman on May 17, 1977, discloses a cap with an interchangeable Crown, where users can change to a multiple of styles of crowns including solid and mesh styles. The crown is held to an unique two piece brim via Velcro straps and the user is able to attach and detach the crown from the brim by releasing several Velcro straps that are located in the interior of the crown. The two piece brim allows for some adjustability for the varying size of the users' heads. U.S. Pat. No. 4,873,726 issued to Tapia on Oct. 17, 1989, discloses a replaceable bill that is sandwiched between an arcuate band and the front part of the brim of the cap. The bill is held in place with Velcro attached to the bill and the brim of the cap. The issue with this design is whether the cap and bill will maintain contact through extreme use and sweat that are present during such activity. Neither of these inventions rely on the actual bill to be the actual attachment and adjustment mechanisms for the product. It is important that the crown and the bill act autonomously, as in the act of "telescoping" or rolling, curling or bending of the bill into a conical like section. Using with Tapia or Huffman, the bill would simply tear away from the Velcro straps holding it in place exposing the crown in an unnatural way. The bill and crown must be flexible together while maintaining their new shape, not restricting the new shape.

What is needed then is a cap with replaceable bills, a cap which is easily manufacturable, where the actual bill is the sole means of attachment and adjustment for the cap to the wearer's head.

What is needed is a cap with a replaceable bill, whereby the bill can be shaped or flattened, while the crown, though in contact with the bill, can adjust to and maintain a new shape following the contour of the shaped bill.

What is needed is a cap whereby the user can change the crown of the cap and/or the bill of the cap to suit whatever desires they have, and this interchangeability is done with minimum time and effort, without even the need to remove the cap from the users head to replace the crown.

DESCRIPTION OF THE INVENTION

The uniqueness of this invention is found in the continuous use of the brim of the hat, for both guidance of the bill as well as the means for holding the bill in location as well. One embodiment includes the use of an attachment means, disclosed here as a series of interlocking buttons to secure the bill to the crown to prevent slippage of the crown about the brim of the hat, such dislodgement that could occur in extreme usage of the cap during sporting events is prevented, but where said attachment means does not restrict the ability of the user to shape the bill as required or desired. As the bill is a single piece with the adjustment means, the bill is in contiguous contact with the entire cap preventing displacement during use. The uniqueness of this invention is also found in that the bill and the adjustment means are one piece, increasing the ease of manufacturing and assembly, while also allowing for external adjustment of the size of the hat while being worn. An embodiment of this invention allows for a detachable crown and bill of the cap, so that the user can easily change the crown of the hat without effort, or to change the bill of the hat without facing any issues.

DESCRIPTION OF THE DRAWINGS

The following description and the figures to which they refer are provided for the purpose of describing examples and select embodiments of the invention only and are not intended to exhaustively describe all possible examples and embodiments of the invention. Many specific implementations of the following described system will be apparent to those skilled in the art.

FIG. 1; A frontal view of the hat is shown where the panels of the hat are translucent allowing one to see the interior of the crown and the brim areas.

FIG. 2; A bottom view of the hat is shown as an exploded view, where the one-piece bill and adjustment means are shown prior to assembly.

FIG. 3; A bottom view of the hat is shown as an assembly view, where the one-piece bill and adjustment means are shown as being inserted into the brim of the hat FIG. 4; A bottom view of the hat is shown as an assembled unit, where the one-piece bill and adjustment means are shown as being in the process of adjustment.

FIG. 6; A bottom view of the hat is shown as an exploded view, where the one-piece bill and adjustment means are shown prior to assembly.

FIG. 6A; A detail view of the front portion of the bill showing the attachment means.

FIG. 7; A bottom view of the hat is shown as an assembly view, where the one-piece bill and adjustment means are shown as being inserted into the brim of the hat FIG. 8; A bottom view of the hat is shown as an assembled unit, where the one-piece bill and adjustment means are shown as being in the process of adjustment.

FIG. 9; A frontal view of the hat is shown where the panels of the hat translucent in order for one to view the interior of the crown and brim areas.

FIG. 10; An exterior frontal view of the crown portion of the hat, with translucent panels.

FIG. 11; An exterior frontal view of the bill portion of the hat.

FIG. 12; An interior view of the assembled hat including the bill and crown portion.

FIG. 13; A rearward view of the bottom of the assembled hat including the bill and crown portions, showing the "flex-fit" style of hat, where the adjustment means is elastic and the rear vent portion is missing.

Figure 5:
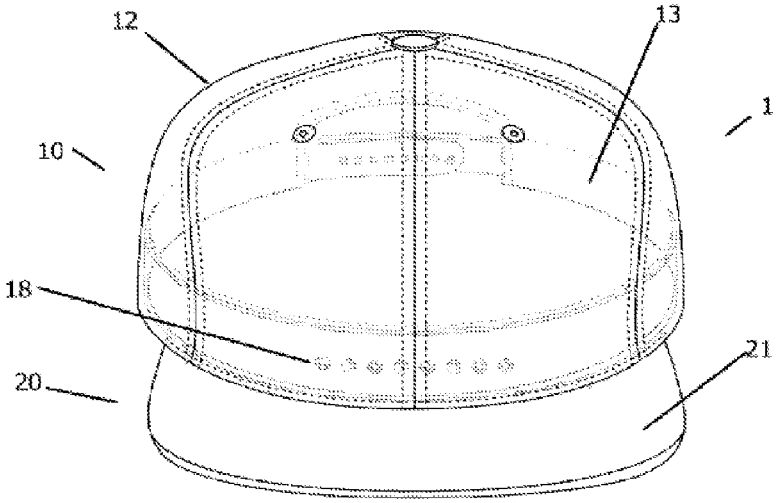
FIG. 5; A frontal view of the hat is shown where the panels of the hat are translucent allowing one to see the interior of the crown and the brim areas, this view details an embodiment of the invention whereby attachment means is disclosed.
Figure 5:
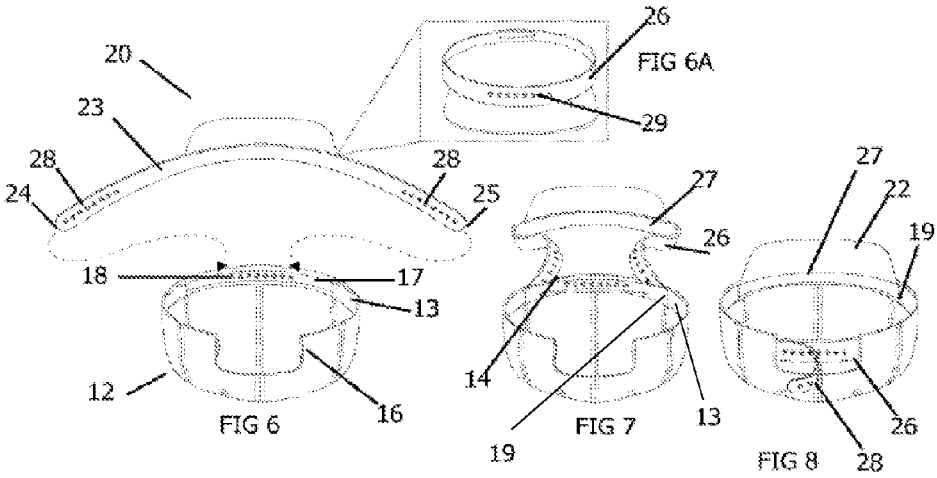

There is nothing implied or construed that limits the color or opacity of the panels in this application and panels are shown as translucent to aid in the understanding of the invention.

A DETAILED DESCRIPTION OF THE DRAWINGS

FIG. 1 shows hat (1) comprising two main parts; bill (20) and crown (10). Hat (1) is in it's assembled condition, whereby replaceable bill (20) has been inserted into and is connected to crown (10) as a completed unit. Crown (10) consists either of a single panel or a multiple number of panels (12). When multiple panels are used, said panels being generally triangular in shape having a anterior end (12*a*) and a distal end (12*d*), said panels normally being attached to one another, in this case via stitching (12*s*). Anterior ends (12*a*) are conjoined together traditionally with a snap or button (12*b*) which hold the ends (12*a*) together. Also traditionally seen are grommets or eyelets for air holes (12*h*) allowing for the escape of hot air from the interior portion of the crown (11) to the exterior.

FIG. 1 also shows that the distal end (12*d*) is folded back upon itself towards interior (11) to form inner sleeve (13) which terminates at the rear vent portion (15*r*) as shown in FIG. 2. It is also an embodiment of this invention to have a "flex-fit" style of hat where said rear vent portion does not exist, as seen in FIG. 13, where in this instance inner sleeve (13) could be located about the entire parameter of said interior (11). Sleeve (13) circumscribes about the open portion of crown (10), said sleeve (13) having a distal portion (13*d*) which forms the exterior edge of crown (10) and an anterior portion (13*a*) which extends interiorly from distal portion (13*d*) inwardly attaching to the interior portion of panel (12). Sleeve (13) is designed to encapsulate the FIG. 2 details that sleeve pocket (14) is a section of sleeve (13) whereby pocket (14) is an opening along the distal portion (13*d*) of sleeve (13) that is located at the front of the crown (15*f*). Ingress pocket (14) is circumscribed about a length along the open portion of crown (10). Pocket (14) is described as that opening defined about the exterior edge of crown (10) extending on each side of the centerline (10*c*) of crown (10), said opening terminated at pocket closure (14*c*) approximately 30-45 degrees from said centerline (10*c*).

FIG. 2 also details the bill portion (20) which includes strap (23), said strap having an interior face (27) and an exterior face (26), said strap being a single piece of flexible semi-rigid material possessing flexural properties whereby said material is rigid enough to hold its vertical shape yet be flexible longitudinally to be bent in such a manner as shown in FIG. 3, and having the residual memory to want to maintain a straight orientation, such memory being critical as it forms the basis for the stiffness of the lower portion of the open portion of crown (10). Strap (23) contains bill (20) which is centered about the length of strap (23) and said strap (23) terminates at the extreme ends (24) of said strap (23), said extreme ends being rounded about the horizontal axis of said strap (23). Such material must also be capable of allowing the attachment of bill (20) onto said strap (23) in a permanent manner. Near the tang ends (24) there exists adjustment means (28), said means having co-dependant attachment components, such that each end of strap (23) has one component of said means located on either the interior face (27) or the exterior face (26) and the other end has the mating component of said means located on the opposite face of said strap. FIG. 13 also details another means for adjustment, in which there is no egress for the tangs to be exposed, but rather the rear of the cap is closed with solid material having elastic bands sewn into the distal end of the panel(s). FIG. 4 shows the interaction between the components of the adjustment means. In this invention, the adjustment means could be either Velcro like hook and eye mating material (not shown), sliding ratchet mechanism (not shown) or a selectable post engagable tang (26) with corresponding mating eyes or apertures on the opposite tang (28).

FIG. 3 details how strap (23) flexural attributes are demonstrated as terminating end (24) of said strap are guided into each pocket closure (14*c*), said strap being guided through sleeve (13) until said ends (24) emanate out of rear egress pocket opening (16) and bill (20) is securely mated against open portion of crown (10). Sleeve (13) encapsulates strap (23) about the entire parameter of the interior of the crown portion. FIG. 4 shows the proper engagement of the strap (23) into sleeve (13) and the mating of adjustment means (28). It can be seen that strap (23) provides the rigidity that makes the open portion of crown (10) stiff and reinforces the cap so that the panels are held at their proper shape and form while securely attaching the cap onto the user's head.

Bill (20) has an exterior side (21) and an interior side (22) is made of a material that is capable of secure attachment to strap (23) and has flexural characteristics that will enable it to hold it's shape and composition while being bent or flattened. Bill (20) is usually covered with cloth or felt to enhance it's attractiveness to the user.

An embodiment of the invention is disclosed in FIG. 5 where strap (23) has rotational displacement prevention means with mating halves (29) and (18) mounted upon said exterior of said strap (26) and mounted upon interior portion of crown (10) respectively. FIG. 5 discloses a post and aperture system as seen through the translucent panels (12). FIG. 6 shows the location of one of the mating halves of the rotational displacement prevention means (18) is attached to securement strip (17) along the edge of the open portion of crown (10). In this embodiment, sleeve (13) is broken into two separate sleeves which are also formed by the exterior edge of the open portion of crown (10). Sleeve opening (19) is located at the termination of each end of strip (17) allowing access to sleeve (13). FIG. 6A shows the one half of the rotational displacement prevention means (29) located on the exterior face (26) of strap (23), said means centered about the centerline of bill (20). The mating of the two halves of the rotational displacement prevention means posts (29) and eyes (18) are engaged by pressure once the strap 23 is inserted into sleeves (13). In this example, a post and eye configuration in shown in FIGS. 5, 6, and 7. This invention is not limited to a post and eye style of rotational displacement prevention means. The purpose of the post and eye is to prevent the bill portion (20) from rotating unnecessarily and unwantingly about crown portion (10). Other means to prevent rotation can be the use of hook and eye materials, such as Velcro (not shown), adhesives and decorative buttons (not shown). This invention is not limited by this disclosure as there exists many alternative means to prevent the displacement of the crown portion in relation to the bill portion of the cap. FIG. 7 shows the assembly of strap (23) into sleeves (13) on each side of crown (10) and FIG. 8 shows the completed assembly. The composition of bill (20) in this embodiment along with the construction of crown (10) is the same as disclosed previously.

FIG. 9 details another embodiment of the invention. In this embodiment, the anti-rotational securement means interfaces with mating halves (118)/(129) are mounted upon the interior of crown (100) and bill portion (200) respectively. In this embodiment, a hook and eye mating material (120), such as that marketed under the tradename of Velcro, is placed along the exterior face (129) of bill strap (126). This application does not limit the interfacing material to be hook and eye style, and applicant envisions the use of adhesives or magnetic means to interface one half to the other. Bill strap (126) emanates from the rearmost edge of upper portion (121) of bill (120) Said hook and eye material (124) is placed circumferential about the exterior face (129) until the material reaches the adjustment means (128). In this embodiment, FIG. 12 shows the interaction between the components of the adjustment means. In this invention, the adjustment means could be either Velcro like hook and eye mating material (not shown), sliding ratchet mechanism (not shown) or a selectable post engagable with corresponding mating apertures (128).

FIG. 11 shows both the exterior face (129) covered in the material (124) and the interior face (130) of strap (126). Interior face (130) is covered with a lining material that would make it comfortable to wear for the user, such as terry cloth or materials that wicks away sweat and moisture. Crown (100) has panels (112) the join together at their narrowest portion (112*a*) at button (112*b*). The panels extend downwardly to the lower crown edge (117). On the interior portion of crown (100) nearest crown edge (117) is crown mating half (118). Mating half (118) is the opposing mating surface to material (121) and securely yet detachably attaches bill (200) to crown (100) allowing for the interchange of crown portion (100) from bill portion (200) as the user deems fit. The user in this embodiment, simply raises and the lowers the crown (100) onto bill (200) to engage the two pieces. FIG. 12 shows the interior of the invention showing the underside of bill (122) and interior face (130) of an assembled cap.

FIG. 13 shows yet an embodiment of the invention where any of the above embodiments of the invention can be used with the "flex fit" style of cap. The "flex fit" style of cap has elastic bands along the rearmost section of the lower portion of the crown, precluding the need for a physical adjustment means (28/26 or 128/126), where the adjustment means is elastic that is sewn into the distal end of the crown portion.

It will be appreciated by those skilled in the art, that the invention is herein described with reference to certain examples or preferred embodiments as shown in the drawings. Various additions, deletions, changes and alterations may be made to the above-described embodiments and examples without departing from the intended spirit and scope of this invention which is to provide a user with the flexible option of exchanging the bill of their cap with ease having said bill being integrated with a strap containing the adjustment means and alternatively, securement means as well.

What is claimed is:

1. A baseball style cap with an interchangeable bill comprising:

a bill including a flexible strap having first and second ends emanating from a horizontal axis of the bill, wherein the distal end regions of the first and second flexible strap ends are adjustably attachable to each other; and a crown being hemispherical in shape and having a circular edge defining an interior surface and an exterior surface, wherein the interior surface adjacent the circular edge includes an inner sleeve;

wherein the inner sleeve comprises portions attached to and extending from the circular edge to an interior portion of the crown and a portion of the sleeve that is unattached to the circular edge along a front region of the crown;

wherein the first and second ends of the flexible strap are sized to fit slidably through the inner sleeve portions, and wherein the inner sleeve extends continuously between a first and second egress opening so that the distal end regions of the first and second flexible strap ends extend beyond the inner sleeve to permit adjustable attachment thereof.

2. The baseball style cap of claim 1, wherein the distal end regions of the first and second flexible strap ends are adjustable via hook and loop fasteners.

3. The baseball style cap of claim 1, wherein the distal end regions of the first and second flexible straps are adjustable via a sliding ratchet mechanism.

4. The baseball style cap of claim 1, wherein the distal end regions of the first and second flexible strap ends are adjustable via a selectable posts engagable with corresponding mating apertures.

5. The baseball style cap of claim 1, wherein a majority of the flexible strap between the distal end regions is continuously encapsulated in the inner sleeve.

6. The baseball style cap of claim 1, wherein the inner sleeve encapsulates the flexible strap a majority of the perimeter of the circular edge.

7. The baseball style cap of claim 1, wherein the inner sleeve extends continuously along a majority of the circular edge.

* * * * *